US006506018B1

(12) United States Patent
Brennan

(10) Patent No.: US 6,506,018 B1
(45) Date of Patent: Jan. 14, 2003

(54) CASING DESIGN FOR ROTATING MACHINERY AND METHOD FOR MANUFACTURE THEREOF

(75) Inventor: Raymond J. Brennan, Pittsburgh, PA (US)

(73) Assignee: Elliott Turbomachinery Co., Inc., Jeannette, PA (US)

( * ) Notice: Subject to any disclaimer, the term of this patent is extended or adjusted under 35 U.S.C. 154(b) by 0 days.

(21) Appl. No.: 09/889,462

(22) PCT Filed: Jan. 25, 2000

(86) PCT No.: PCT/US00/01746

§ 371 (c)(1),
(2), (4) Date: Jul. 16, 2001

(87) PCT Pub. No.: WO00/43640

PCT Pub. Date: Jul. 27, 2000

Related U.S. Application Data

(60) Provisional application No. 60/117,090, filed on Jan. 25, 1999.

(51) Int. Cl.[7] ..... F01D 25/24
(52) U.S. Cl. ..... 415/214.1; 415/220
(58) Field of Search ..... 415/214.1, 200, 415/220; 29/889.2, 889.012, 557, 558

(56) References Cited

U.S. PATENT DOCUMENTS

| | | | | |
|---|---|---|---|---|
| 1,352,276 A | | 9/1920 | Junggren | |
| 1,839,849 A | | 1/1932 | Hodgkinson | |
| 1,957,699 A | * | 5/1934 | Dahlstrand | 220/693 |
| 2,095,128 A | * | 10/1937 | Doran | 220/679 |
| 2,247,125 A | * | 6/1941 | Hall | 220/693 |
| 2,683,017 A | | 7/1954 | Gallaway | 253/39 |
| 2,815,645 A | * | 12/1957 | Downs | 165/134.1 |
| 3,160,107 A | | 12/1964 | Ross | 103/111 |
| 3,390,830 A | | 7/1968 | Kahane | 230/133 |
| 3,544,232 A | | 12/1970 | Zerlauth | 415/219 |
| 4,137,006 A | | 1/1979 | Becker | 415/201 |
| 4,218,181 A | | 8/1980 | Komatsu et al. | 415/189 |
| 4,305,192 A | | 12/1981 | Becker | 29/156.4 R |
| 4,362,464 A | | 12/1982 | Stock | 415/136 |
| 4,551,065 A | | 11/1985 | Becker | 415/219 R |
| 4,915,581 A | | 4/1990 | Groenendaal, Jr. et al. | 110/262 |
| 5,063,661 A | | 11/1991 | Lindsay | 29/888.02 |
| 5,149,248 A | | 9/1992 | Cramer | 415/169.2 |

FOREIGN PATENT DOCUMENTS

| | | | |
|---|---|---|---|
| JP | 58-138208 A | 8/1993 | F01D/9/04 |

* cited by examiner

*Primary Examiner*—Edward K. Look
*Assistant Examiner*—Ninh Nguyen
(74) *Attorney, Agent, or Firm*—Webb Ziesenheim Logsdon Orkin & Hanson, P.C.

(57) ABSTRACT

A casing design for rotating machinery that includes two semi-cylindrical shaped shell sections. Each of the sections includes a machined flange adapted to receive fasteners. The two sections are attached together through fasteners passing through the machined flanges.

17 Claims, 6 Drawing Sheets

CASING DESIGN FOR ROTATING MACHINERY AND METHOD FOR MANUFACTURE THEREOF

This application claims the benefit of provisional application No. 60/117,090 filed Jan. 25, 1999.

BACKGROUND OF THE INVENTION

1. Field of the Invention

This invention relates to casings for rotating machinery and, more particularly, to split casings for use with gas compressors.

2. Brief Description of the Prior Art

FIG. 1 shows a prior art split casing section A for use with a gas compressor. The split casing section A includes a semi-cylindrical rolled plate B having two opposing edges C, C' and extending about a longitudinal axis X. A pair of flanges D, D' extend along each the opposing edges C, C' with each flange D, D' attached to the semi-cylindrical rolled plate B through welds E. The flanges D, D' define a plurality of bore holes F that extend from a top flange side G to a bottom flange side H.

Two of the prior art split casing sections A are traditionally joined together at their respective flanges D, D', forming a cylindrically shaped split case assembly. The split casing sections A are secured by fasteners, such as bolts, passing through the bore holes F. Rotating machinery components, such as compressor components, are then received within a cavity defined by inner surfaces of the joined split casing assembly.

One method for manufacturing a split casing section A is to roll a flat plate K (shown in FIG. 2), about the longitudinal axis X into a semi-cylindrical shaped rolled plate B. As shown in FIG. 3, flanges D, D' are then secured to the rolled plate B at edges C, C' through welds E (shown in FIG. 1). The bore holes F are drilled or formed in the flanges D, D' prior to welding the flanges D, D' to the rolled plate B or after the welding of the flanges D, D' to the rolled plate B.

The prior art split casing sections A shown in FIGS. 1 and 3 are expensive to manufacture due to numerous welds. Further, there always exists a possibility of failure due to improper welds between the flanges D, D' and the rolled plate B. Other prior art casing designs are shown in U.S. Pat. Nos. 1,352,276; 1,839,849; 2,683,017; 3,160,107; 3,390,830; 3,544,232; 4,137,006; 4,305,192; 4,551,065; 4,915,581; and, 5,063,661.

Therefore, it is an object of the present invention to provide a split casing section design that is less expensive to manufacture and does not require welded flanges.

SUMMARY OF THE INVENTION

The present invention is a casing design for rotating machinery, such as gas compressors or turbines, that generally includes a first casing section, a second casing section, and a plurality of fasteners. The first casing section is formed from a single plate into a substantially semi-cylindrical shaped shell having two opposing edges, two opposite external sides, and machined flanges. The second casing section is also formed from a single plate into a substantially semi-cylindrical shaped shell having two opposing edges, two opposing edges, and machined flanges. Opposing edges of each first casing section are aligned with corresponding opposing edges of each second casing section to form a substantially cylindrical structure held together by the plurality of fasteners. The fasteners pass through bore holes formed by each of the machined flanges.

A hollow receiving cavity is defined by inner surfaces of the joined first and second casing sections, as well as end plates joined to the first and second casing sections. The receiving cavity can receive rotating machinery components, such as compressor or turbine components.

The present invention is also a method for manufacturing a one-half section of a split casing assembly that includes the steps of:

a. providing a substantially semi-cylindrical casing section; and b. forming flanges on opposite exterior sides of the semi-cylindrical section by removing material from the substantially semi-cylindrical shaped casing section. The method can also include the steps of, c. forming a plurality of bore holes in the flanges;

d. forming port holes in the casing section;

e. connecting ports to the port holes; and f. connecting the semi-cylindrical casing section to another semi-cylindrical casing section, forming a cylindrically shaped split casing assembly having a hollow receiving cavity in fluid communication with the ports.

DETAILED DESCRIPTION OF THE PREFERRED EMBODIMENT

Figure 1:
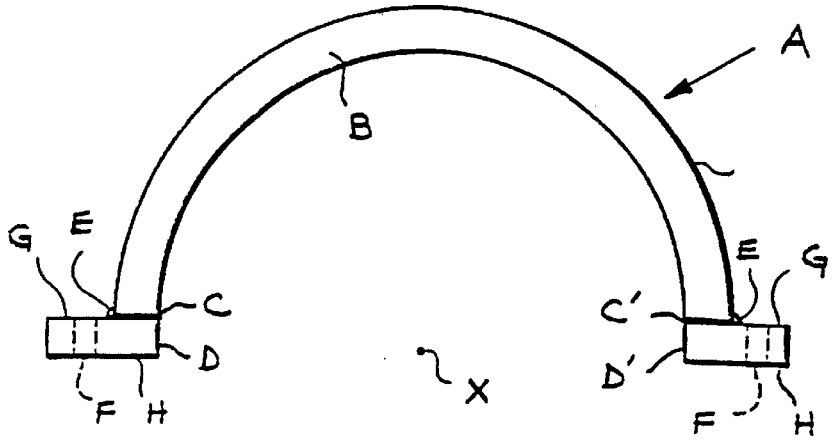
Fig. 1 PRIOR ART
FIG. 1 is an elevational end view of a prior art split casing section.
Figure 2:
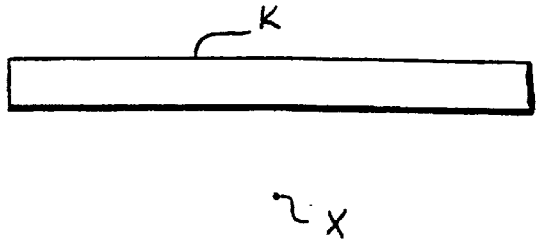
Fig. 2 PRIOR ART
FIG. 2 is an elevational end view of a flat plate used to manufacture the prior art split casing section shown in FIG. 1.
Figure 3:
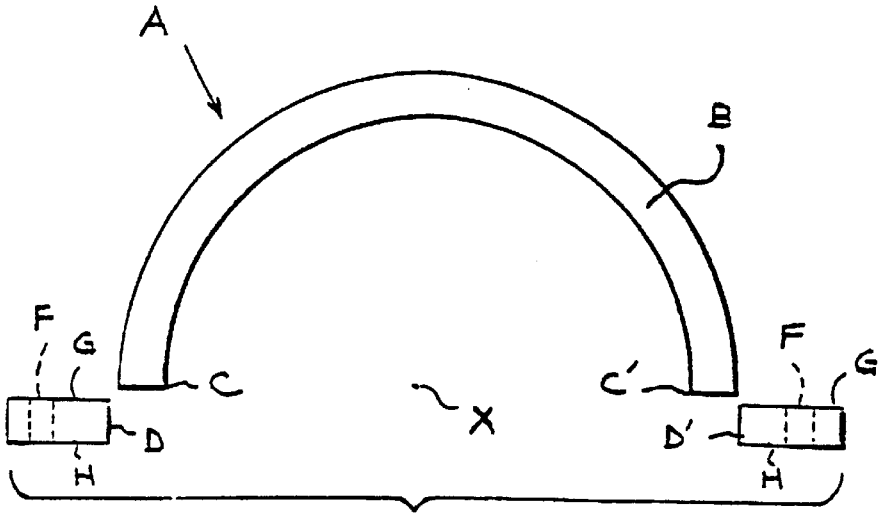
Fig. 3 PRIOR ART
FIG. 3 is an exploded elevational end view of the prior art split casing section shown in FIG. 1.
Figure 4:
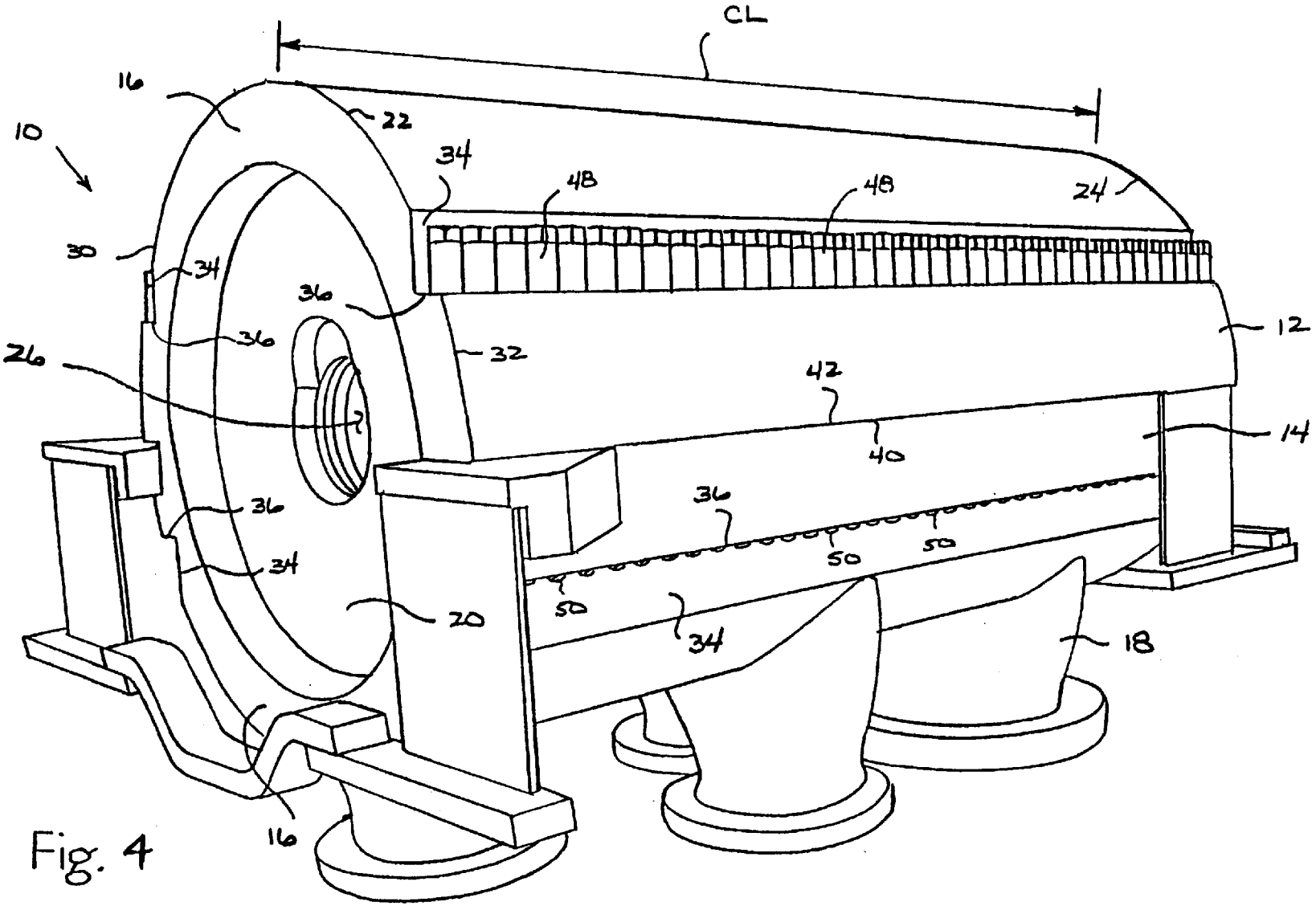
FIG. 4 is a perspective view of a casing design for rotating machinery having a first casing section and a second casing section made in accordance with the present invention.
Figure 5:
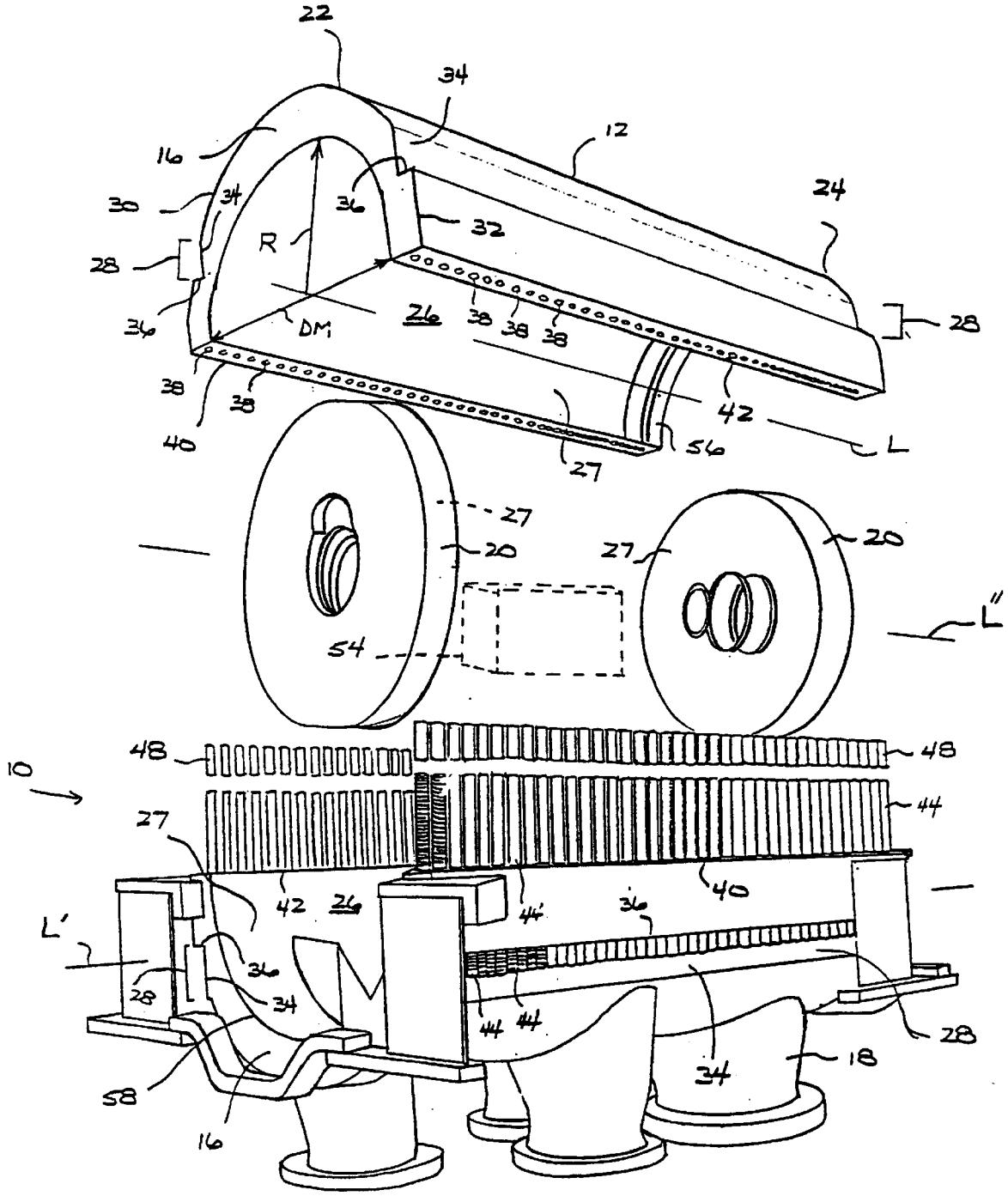
FIG. 5 is an exploded perspective view of the casing design for rotating machinery shown in FIG. 4.

FIGS. 4 and 5 show a split casing assembly 10 for rotating machinery made in accordance with the present invention. The present invention generally includes a first casing section 12 attached to a second casing section 14. The first casing section 12 and the second casing section 14 are made from rolled plate 16, preferably steel, and form semi-cylindrical shaped shell structures, each having the same radius of curvature R. Alternatively, it is believed that the first casing section 12 and the second casing section 14 can be cast or forged. The split casing assembly 10 is adapted to receive rotating machines 54 (shown schematically), such as components for a gas compressor or a gas turbine. A plurality of ports 18 are attached to the first casing section 12 or, as shown in FIGS. 4 and 5, to the second casing section 14. End plates 20 are secured to first and second opposite ends 22, 24 of the split casing assembly 10 and may be equipped with seals to form a sealed pressure arrangement.

Referring specifically to FIG. 5, a hollow receiving cavity 26 is defined by inner surfaces 27 of the first casing section 12, the second casing section 14, and the end plates 20. The hollow receiving cavity 26 is adapted to receive rotating machinery 54, such as components for a compressor or a turbine, as shown in FIG. 5.

With continuing reference to FIG. 5, as well as FIG. 4, the first casing section 12 is a substantially semi-cylindrical shaped shell or rolled plate 16 that extends along a longitudinal axis L. The first casing section 12 has radius R, a longitudinal length CL, first and second external sides 30, 32, and includes two machined flanges 28 each positioned on the first or second external sides 30, 32 and each extending the longitudinal length CL of the first casing section 12. The machined flanges 28, shown in greater detail in FIG. 6, are defined by two surfaces, a first surface 34 and a second surface 36, which are substantially transverse or perpendicular to one another.

Figure 7:
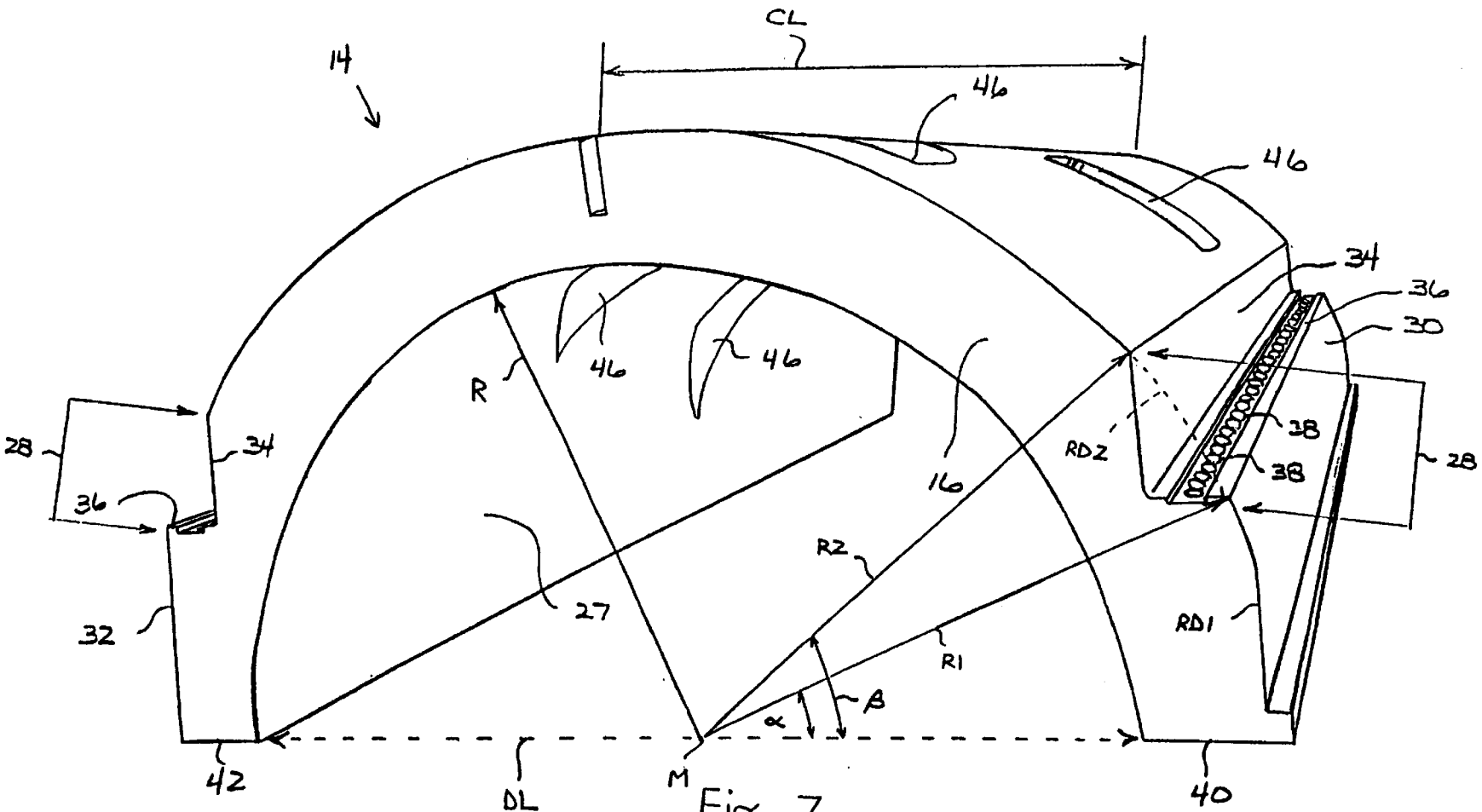
FIG. 7 is a top perspective view of the second casing section shown in FIG. 4.
Figure 8:
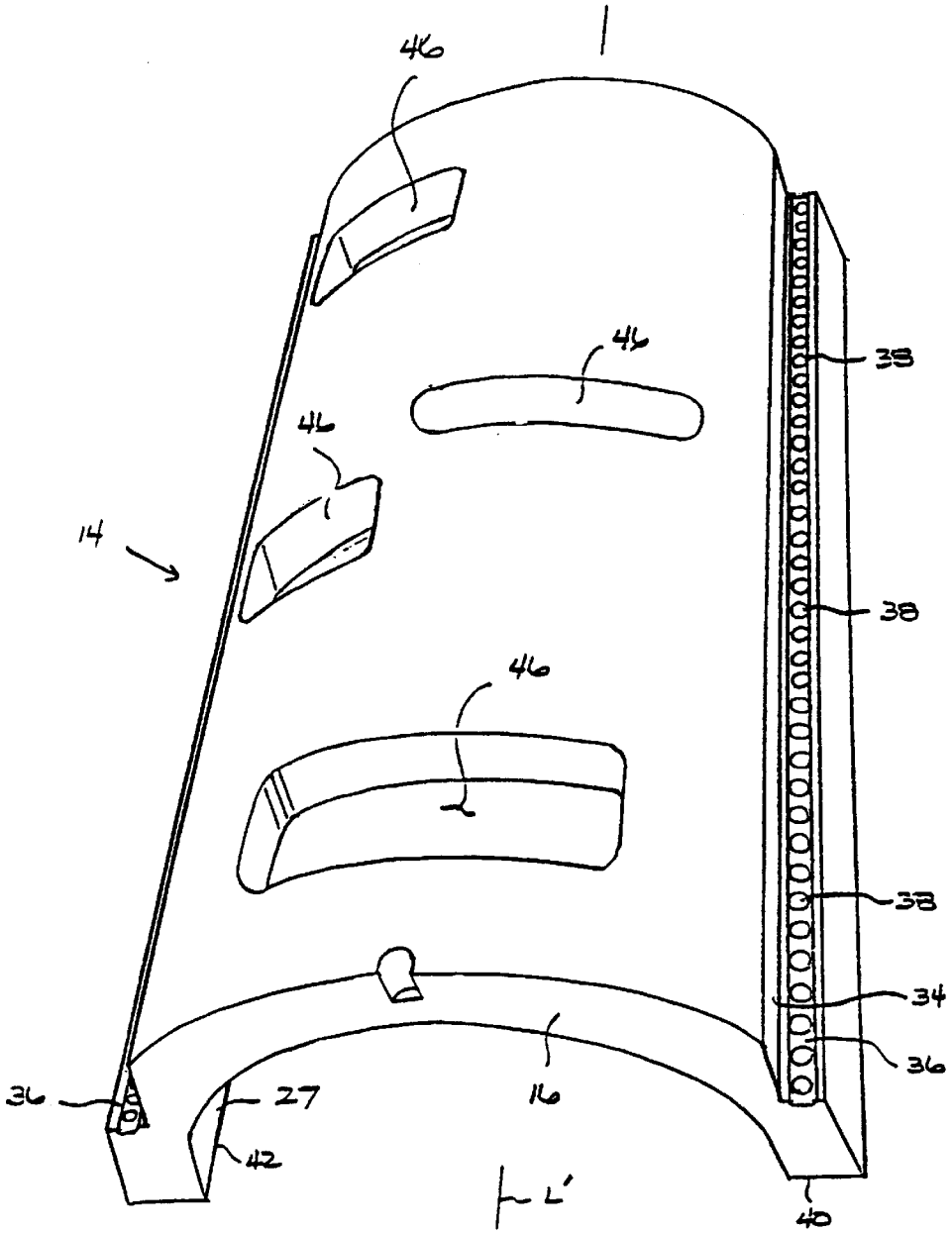
FIG. 8 is another top perspective view of the second casing section shown in FIGS. 4 and 7.

The second casing section 14, shown in detail in FIGS. 7 and 8, is similar to the first casing section 12 and like reference numerals will be used for like elements. The second casing section 14 has radius R, a longitudinal length CL, first and second external sides 30, 32, and includes two machined flanges 28 extending the longitudinal length CL of the second casing section 14. The machined flanges 28 are defined by two surfaces, a first surface 34 and a second surface 36, which are substantially transverse or perpendicular to one another. The first and second casing sections 12, 14 are preferably thick enough to allow machined flanges 28 and still function as a pressure vessel. Likewise, the end plates 20 are also preferably thick enough to withstand elevated pressures.

One difference between the first and second casing sections 12, 14 is that a plurality of port holes 46 are preferably defined on the second casing section 14, as shown in FIGS. 7 and 8, although the first casing section 12 can form port holes 46 as well. Referring to FIGS. 4 and 5, the ports 18 are welded to the second casing section 14. The ports 18 are adapted to align with the port holes 46 so that the ports 18 are in fluid communication with the hollow receiving cavity 26.

Figure 6:
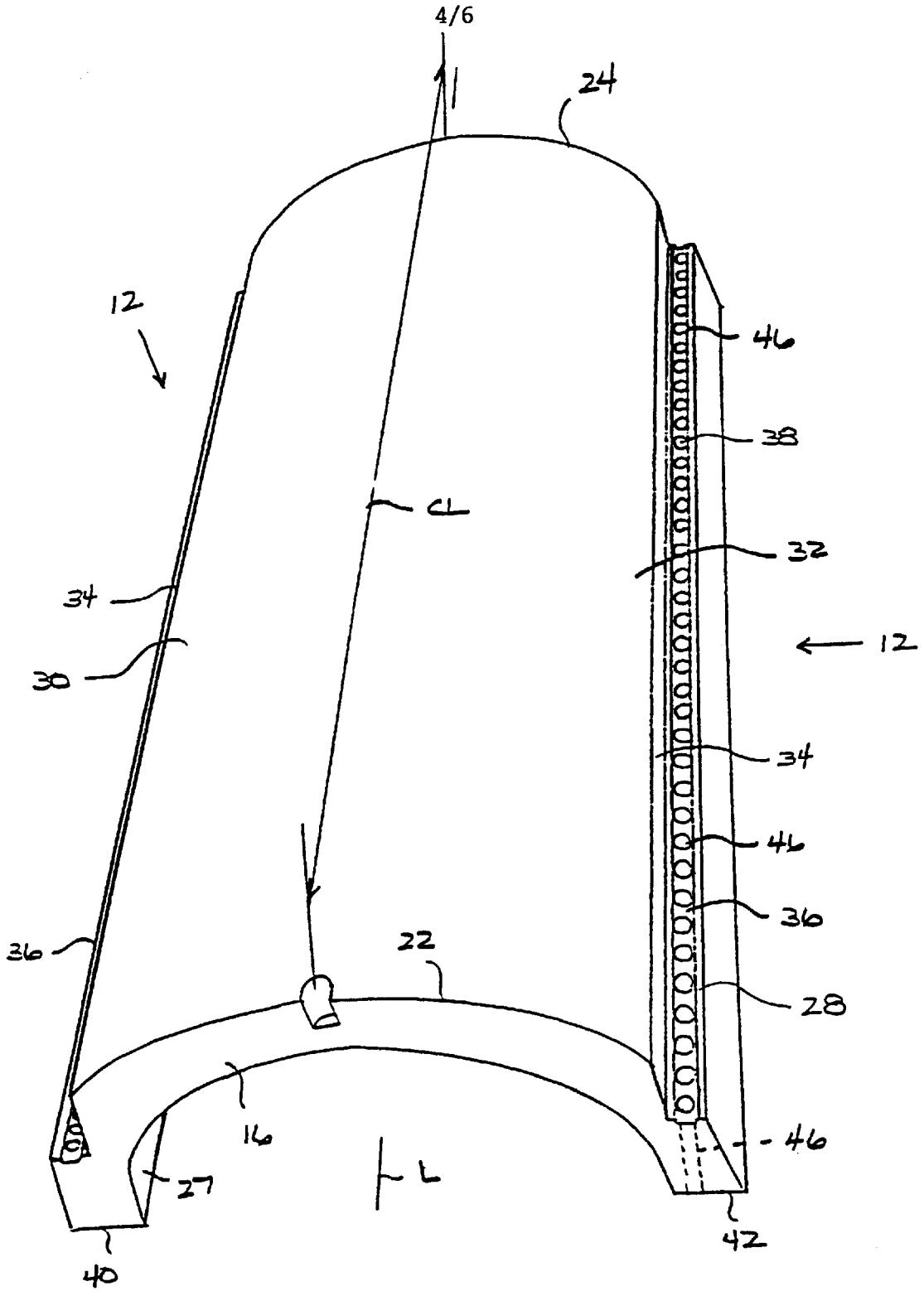
FIG. 6 is a top perspective view of the first casing section shown in FIG. 4.

As shown in FIG. 6, the machined flanges 28 are integrally formed on the first and second external sides 30, 32 of the first and second casing sections 12, 14 at circumferential distances RD1 and RD2. Circumferential distances RD1 and RD2 are functions of angles $\alpha$ and $\beta$ and their corresponding radius vectors R1 and R2. Radius vectors R1 and R2 originate at a midpoint M of an imaginary diameter line DL that connects the first and second opposite ends 22, 24 of the first casing section 12 and/or the second casing section 14 and is equal in length to the interior diameter DL of the casing sections 12, 14. In contrast to radius R, shown in FIG. 5, radius vectors R1 and R2 extend to the external sides 30, 32 of the casing sections 12, 14.

A plurality of bore holes 38 are drilled or formed through the respective second surfaces 36 of the flanges 28. The bore holes 38 extend from the second surfaces 36 to the respective first and second edges 40, 42 of the first or second casing sections 12, 14. The bore holes 38 are spaced along the second surfaces 36 throughout the length CL of the first and second casing sections 12, 14, as shown in FIG. 4, and are configured to receive fasteners, such as bolts.

With continuing reference to FIG. 4, the first casing section 12 is secured to the second casing section 14 by placing or abutting respective first and second edges 40, 42 against each other so that respective bore holes 38 are aligned with one another. Threaded bolts or fasteners 44, shown in FIG. 5, pass through the bore holes 38 until threaded ends of the bolts 44 extend from the second surfaces 36 of the flanges 28 in the second casing section 14. Threaded ends of the bolts 44 also extend from the second surfaces 36 of the first casing section 12. Threaded cover nuts 48 are threadably received by the ends of the bolts 44 positioned adjacent the first casing section 12 and nuts 50 are threadably received by the ends of the bolts 44 positioned adjacent the second casing section 14, so as to secure the first casing section 12 to the second casing section 14 and form a split casing assembly 10. In this arrangement, axes L, L', L" are aligned with one another, wherein the split casing assembly 10 is substantially cylindrical in shape and has a constant radius of curvature R. The end plates 20 can then be secured internally before bolting or externally after bolting to the split casing assembly 10, thereby forming the casing design for rotating machinery 54. Preferably, the end plates 20 are mounted internally against a retaining step or face in the hollow receiving cavity 26 or can be mounted externally with fasteners (not shown).

It should be appreciated that the end plates 20 can be secured to either or both of the first and/or second casing sections 12, 14 and rotating machinery components can be attached to end plates 20 and sections 12, 14 prior to securing the first casing section 12 to the second casing section 14.

Figure 9:
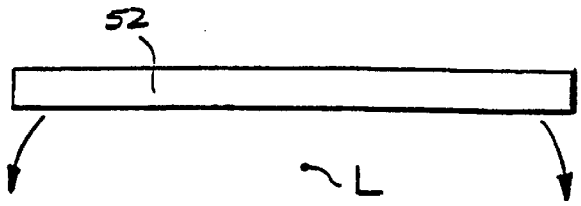
FIG. 9 is a side view of a flat plate.

The method for manufacturing the first casing section 12 is set forth as follows. First, a flat plate 52, preferably made from steel, is provided. As shown in FIG. 9, the flat plate 52 is then rolled in the direction of the arrows so that the plate 52 is curved about the axis L and has a semi-cylindrical shape. As shown in FIG. 6, flanges 28 having first and second surfaces 34, 36 are then machined in the rolled plate 16. The first and second surfaces 34, 36 are defined on opposite sides 22, 24 of the rolled plate 16 and the respective surfaces 34, 36 are substantially transverse to one another. A plurality of bore holes 38 are then machined or drilled in the second surfaces 36 of the machined flanges 28. The bore holes 38 can be recessed to provide clearance for nuts 48, 50 and are preferable spaced apart to provide for the bolts 44 and nuts 48, 50. Further, the bore holes 38 are spaced sufficiently away from first surface 34 to provide clearance for nuts 48 and 50. The bore holes 38 extend from the second surfaces 36 to respective first and second edges 40, 42.

As shown in FIGS. 7 and 8, the method for manufacturing the second casing section 14 is substantially the same as the method for manufacturing a first casing section 12 except that a plurality of port holes 46 are formed on the rolled plate 16 by, for example, machining or drilling. Preferably, both the first and second casing sections 12, 14 are semi-cylindrical shaped and have the same radius R of curvature. Ports 18 can be connected to the port holes 46 and the first and second casing sections 12, 14 can be connected to one another, forming a cylindrically shaped split casing assembly 10 having a hollow receiving cavity 26 in fluid communication with the ports 18. Port holes 46 may also be formed in the first casing section 12 or no port holes 46 formed in either the first casing section 12 or the second casing section 14.

The present invention is less expensive to manufacture than the prior art casings, which require separate flanges to be welded to the rolled plate. Further, the present invention results in a stronger design through increased wall thickness and the elimination of welded flanges.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

I claim:

1. A casing for rotating machinery comprising:

a first casing section formed from a single plate into a substantially semi-cylindrical shaped shell, said first casing section having two opposing edges and two opposite external sides, said two opposite external sides having machined flanges forming bore holes;

a second casing section formed from a single plate into a substantially semi-cylindrical shaped shell, said second casing section having two opposing edges and two opposite external sides, said two opposite external sides having machined flanges forming bore holes, said second casing defining a port hole; and a plurality of fasteners, wherein said opposing edges of each first casing section are aligned with corresponding opposing edges of said second casing section to form a substantially cylindrical structure held together by said plurality of fasteners passing through said bore holes.

2. The casing design for rotating machinery as claimed in claim 1 wherein said flanges extend along a length of said first casing section and extend along a length of said second casing section.

3. The casing design for rotating machinery as claimed in claim 1 wherein said machined flanges are defined by a first surface and a second surface, wherein said first surface and said second surface are transverse to one another.

4. The casing design for rotating machinery as claimed in claim 1 wherein said flanges are integrally formed on said external sides of said first and second casing sections.

5. The casing design for rotating machinery as claimed in claim 1 wherein said first and second casing sections are made from steel.

6. A method for manufacturing one-half of a split casing assembly for rotating machinery, comprising the steps of:

a. providing a substantially semi-cylindrical casing section; and b. forming flanges on opposite exterior sides of the semi-cylindrical section by removing material from said substantially semi-cylindrical shaped casing section.

7. A method for manufacturing a split casing section as claimed in claim 6, further comprising the step of forming a plurality of bore holes in said flanges.

8. A method for manufacturing a split casing section as claimed in claim 6, further comprising the step of forming port holes in said casing section.

9. A method for manufacturing a split casing section as claimed in claim 8, further comprising the step of connecting ports to said port holes.

10. A high pressure split vessel comprising:

a first casing section formed from a single plate into a substantially semi-cylindrical shaped shell, said first casing section having two opposing edges, two opposite external sides, and an inner surface, said two opposite external sides having machined flanges forming bore holes;

a second casing section formed from a single plate into a substantially semi-cylindrical shaped shell, said second casing section having two opposing edges, two opposite external sides, and an inner surface, said two opposite external sides having machined flanges forming bore holes, wherein said opposing edges of each first casing section are aligned with corresponding opposing edges of said second casing section to form a substantially cylindrical structure, said second casing defining a port hole;

a plurality of fasteners passing through said bore holes in said second surface of said machined flanges;

at least one end plate having an inner surface joined to said first casing section and said second casing section, wherein said inner surface of said first casing section, said inner surface of said second casing section, and said inner surface of said at least one end plate form a hollow receiving cavity; and a rotating machine positioned inside said hollow receiving cavity.

11. The high pressure split vessel as claimed in claim 10 wherein a port is connected to said port hole.

12. The high pressure split vessel as claimed in claim 11 wherein said hollow receiving cavity is in fluid communication with said port.

13. The high pressure split vessel as claimed in claim 10 wherein said machined flanges extend along a length of said first casing section and extend along a length of said second casing section.

14. The high pressure split vessel as claimed in claim 10 wherein said machined flanges are integrally formed on said external sides of said first and second casing sections.

15. The high pressure split vessel as claimed in claim 10 wherein said first and second casing sections are made from steel.

16. The high pressure split vessel as claimed in claim 10 wherein said rotating machine is a turbine.

17. The high pressure split vessel as claimed in claim 10 wherein said rotating machine is a compressor.

* * * * *